US008757453B1

(12) United States Patent
Olsson

(10) Patent No.: US 8,757,453 B1
(45) Date of Patent: Jun. 24, 2014

(54) POURING SPOUT

(76) Inventor: Sven O. Olsson, Bloomington, MN (US)

( * ) Notice: Subject to any disclaimer, the term of this patent is extended or adjusted under 35 U.S.C. 154(b) by 1081 days.

(21) Appl. No.: 11/818,854

(22) Filed: Jun. 18, 2007

Related U.S. Application Data

(60) Provisional application No. 60/879,467, filed on Jan. 10, 2007.

(51) Int. Cl.
*B65D 25/48* (2006.01)

(52) U.S. Cl.
USPC ..... 222/570; 220/700

(58) Field of Classification Search
USPC ..... 222/570, 475, 569, 567; 220/326, 700, 220/780, FOR. 105, 792, FOR. 101, 733; 215/272, 341
See application file for complete search history.

(56) References Cited

U.S. PATENT DOCUMENTS

| | | | | | |
|---|---|---|---|---|---|
| 2,763,402 | A * | 9/1956 | Livingstone | 222/109 |
| 2,873,881 | A * | 2/1959 | Nichols | 220/697 |
| 3,074,604 | A * | 1/1963 | Baroud | 222/569 |
| 3,679,103 | A * | 7/1972 | Chmela et al. | 222/192 |
| 3,695,488 | A | 10/1972 | Olsson | |
| 3,844,457 | A * | 10/1974 | Smart | 222/570 |
| 3,899,107 | A * | 8/1975 | Gaal | 222/570 |
| 4,004,710 | A * | 1/1977 | Crisci | 220/780 |
| 4,051,951 | A * | 10/1977 | Smith | 206/508 |
| 4,125,210 | A * | 11/1978 | Embree | 222/570 |
| 4,311,238 | A * | 1/1982 | Smith | 206/508 |
| 4,369,890 | A * | 1/1983 | Bennett | 220/733 |
| 4,380,304 | A * | 4/1983 | Anderson | 220/782 |
| 4,568,005 | A * | 2/1986 | Jalovec et al. | 222/472 |
| 4,702,395 | A | 10/1987 | Nitsch | |
| 4,768,668 | A * | 9/1988 | Van Den Brink | 215/305 |
| 4,813,579 | A | 3/1989 | Ciumaga | |
| 4,838,463 | A * | 6/1989 | Roberts | 222/465.1 |
| 4,907,714 | A * | 3/1990 | Gatz | 222/570 |
| 4,917,268 | A * | 4/1990 | Campbell et al. | 222/109 |
| 4,969,617 | A * | 11/1990 | Desjardins | 248/146 |
| 5,137,188 | A | 8/1992 | Thompson | |
| 5,195,662 | A | 3/1993 | Neff | |
| 5,294,015 | A * | 3/1994 | Landis | 220/784 |
| 5,392,969 | A | 2/1995 | Usery | |
| 5,505,347 | A | 4/1996 | Roma | |
| 6,604,647 | B1 * | 8/2003 | Luburic | 220/270 |
| 6,843,389 | B2 * | 1/2005 | Kasting et al. | 222/111 |
| 6,983,869 | B1 * | 1/2006 | Stevens | 222/570 |
| 7,507,936 | B2 * | 3/2009 | Mast et al. | 219/429 |
| 8,291,543 | B2 * | 10/2012 | McCoy et al. | 15/257.1 |
| 2004/0222226 | A1 * | 11/2004 | Gottainer et al. | 220/284 |

* cited by examiner

*Primary Examiner* — Kevin P Shaver
*Assistant Examiner* — Robert Nichols, II
(74) *Attorney, Agent, or Firm* — Richard John Bartz

(57) ABSTRACT

A pouring spout for a paint can has an arcuate base joined to a lip. The base has an arcuate rib with a pocket accommodating a portion of the circular bead of the paint can and an arcuate flange spaced from the rib providing a passage into the pocket. Bosses joined to the flange and rib are compressed against the bead to bias the rib into tight sealing relation with the bead.

2 Claims, 5 Drawing Sheets

POURING SPOUT

CROSS REFERENCE TO RELATED APPLICATION

This application claims the priority of U.S. Provisional Patent Application Ser. No. 60/899,467 filed Jan. 10, 2007.

FIELD OF THE INVENTION

This invention is an attachment for cans that facilitates pouring of liquids, such as paint, stains, and varnishes, from a can. The attachment is a pouring spout mountable in tight sealing relation with the rim of a can to prevent the liquids from flowing under the pouring spout and running down the sides of the can.

BACKGROUND OF THE INVENTION

Paint cans have annular beads and grooves to accommodate lids having annular ribs that cooperate with the beads and grooves to close the open tops of the cans. The beads create a relatively wide turbulent of paint when it is poured from the cans with some paint running down the outside of the cans. Paint also accumulates in the grooves causing spillage when the lids are placed on the cans. The paint in the grooves also causes the lids to stick to the cans. Pouring spouts have been used with paint cans to prevent paint from flowing into the top grooves and running down the outside of the cans. These pouring spouts have one-piece plastic members provided with arcuate grooves accommodating beads to retain the pouring spouts on the cans. The plastic members do not include structures that compensate for molding tolerances and plastic shrinkage to maintain tight seals with the beads of the cans. Examples of paint can pouring spouts are disclosed in U.S. Pat. Nos. 3,695,488; 4,813,579 and 5,195,662.

SUMMARY OF THE INVENTION

The invention relates to an attachment for a container having an annular bead surrounding an open top of the container that cooperates with the bead in a tight sealing relation to prevent liquids from flowing under the attachment, into a groove adjacent the bead, and running down the outside of the container. The attachment includes a pouring spout for use with cans, such as paint, stain and varnish cans to control the flow of these liquids from the cans without allowing the liquid to leak under the pouring spout, flow into the annular grooves in the top of cans and run down the outside of the cans. The pouring spout has an arcuate base and a generally flat lip joined to the base. The base has an arcuate rib with a pocket to accommodate the bead of the can. An arcuate flange spaced from the rib provides a passage into the pocket. One or more bosses joined to the flange bias the rib into tight sealing relation with the bead to prevent leakage of liquid past the pouring spout. One embodiment of the pouring spout has a plurality of spaced bosses with opposite end bosses spaced inwardly from opposite ends of the base.

The invention includes the combination of a container for holding a liquid having an open top and a circular bead and a spout having an arcuate base and a lip joined to the base. The base has a radius of curvature greater than the radius of curvature of the circular bead. The base has an arcuate rib with an arcuate pocket accommodating an arcuate portion of the bead and an arcuate flange spaced from the rib providing a passage into the pocket. One or more bosses joined to the flange compressed against the bead to bias the rib in tight sealing relation with the bead to prevent liquid from leaking between the bead and spout. One embodiment of the pouring spout has a plurality of spaced bosses with opposite end bosses spaced inwardly from opposite ends of the base.

DESCRIPTION OF PREFERRED EMBODIMENTS OF INVENTION

Figure 1:
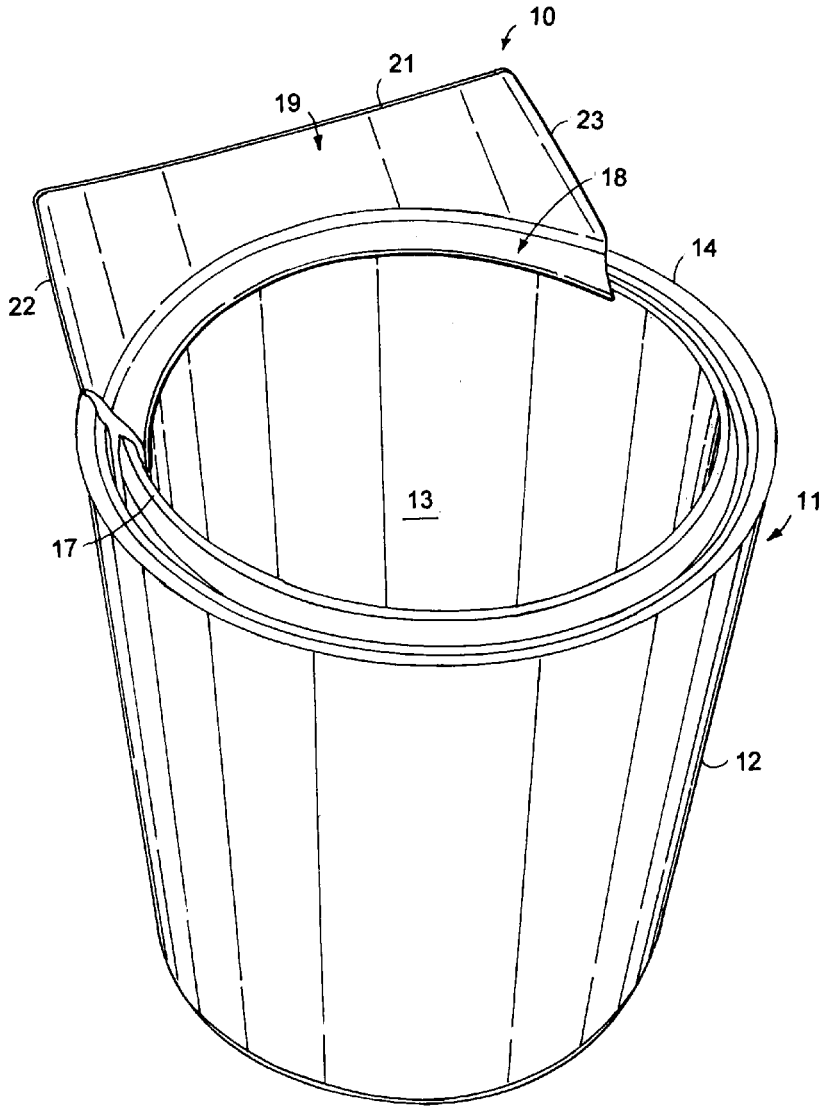
FIG. 1 is a perspective view of a paint can with a pouring spout mounted on the bead of the can.
Figure 10:
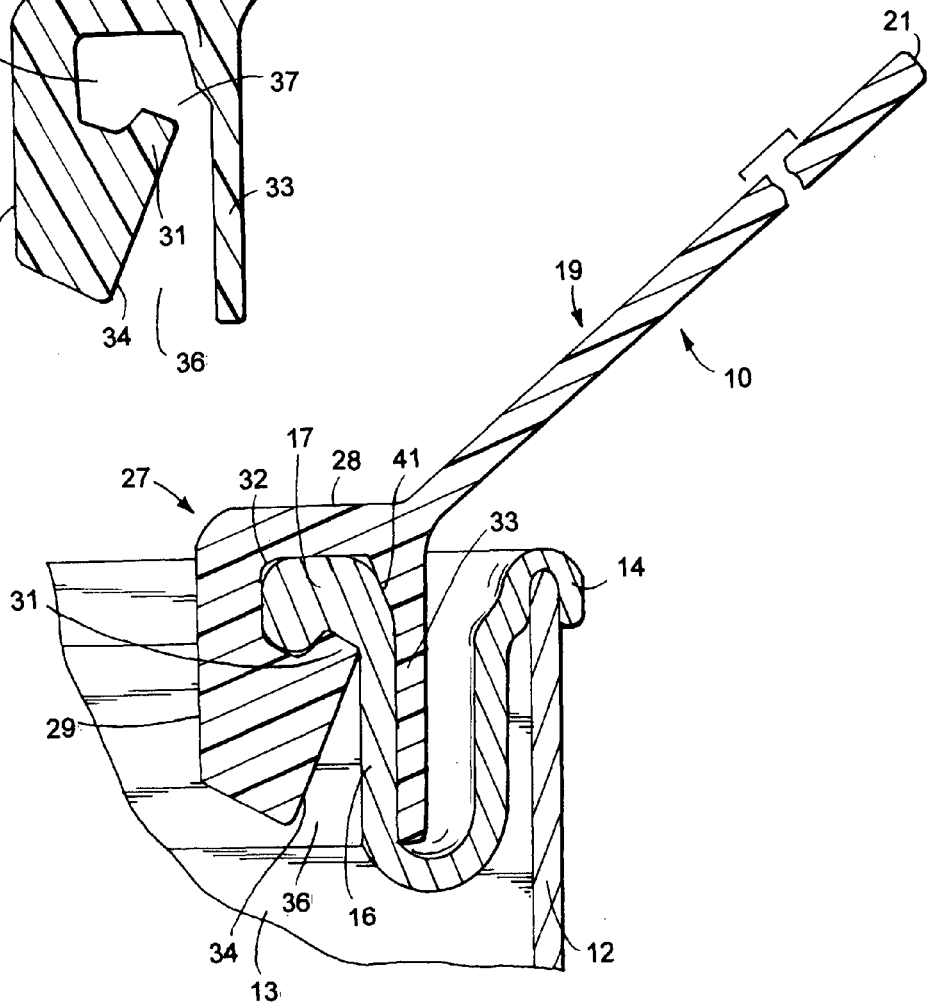
FIG. 10 is an enlarged foreshortened section view of FIG. 9 mounted on the bead of a can.

The pouring spout 10 of the invention, shown in FIG. 1, when attached to an open top container 11, such as a gallon paint can, functions as a concave shaped trough that channels the flow of liquid from the container to another container, pan or surface. The following description is directed to the use of pouring spout 10 with a paint can having a cylindrical side wall 12 surrounding an internal chamber 13 for storing paint. Pouring spout 10 is useable with different sizes and types of containers for paint, liquids, food products, and granular materials. Container 11 has a circular rim 14 adapted to accommodate a circular lid (not shown) to close the open top of the container. Rim 14, clamped on the upper end of side wall 12, as shown in FIG. 10, has a generally upright inside cylindrical wall 16 joined to an inwardly directed circular bead 17.

Figure 2:
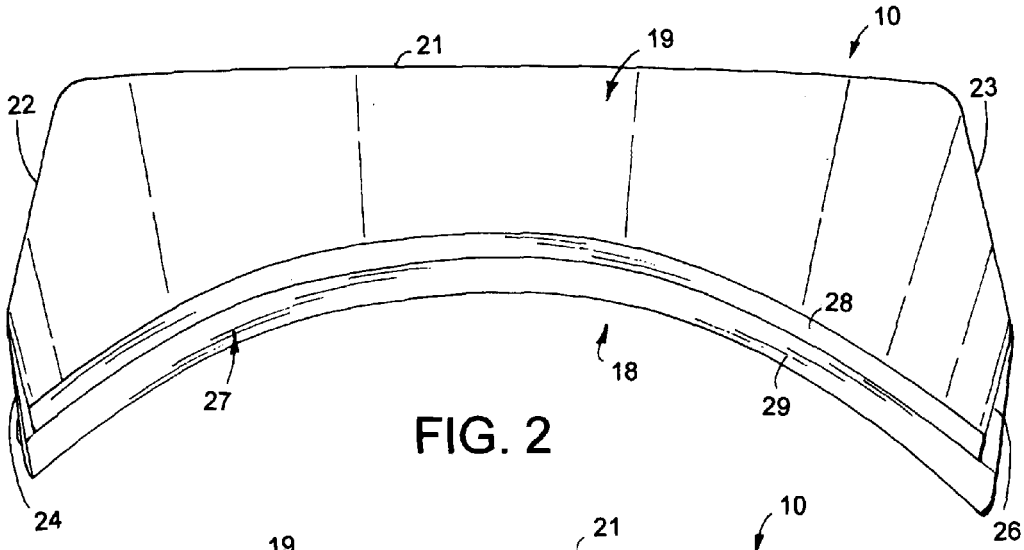
FIG. 2 is a front elevational view of the pouring spout of FIG. 1.
Figure 3:
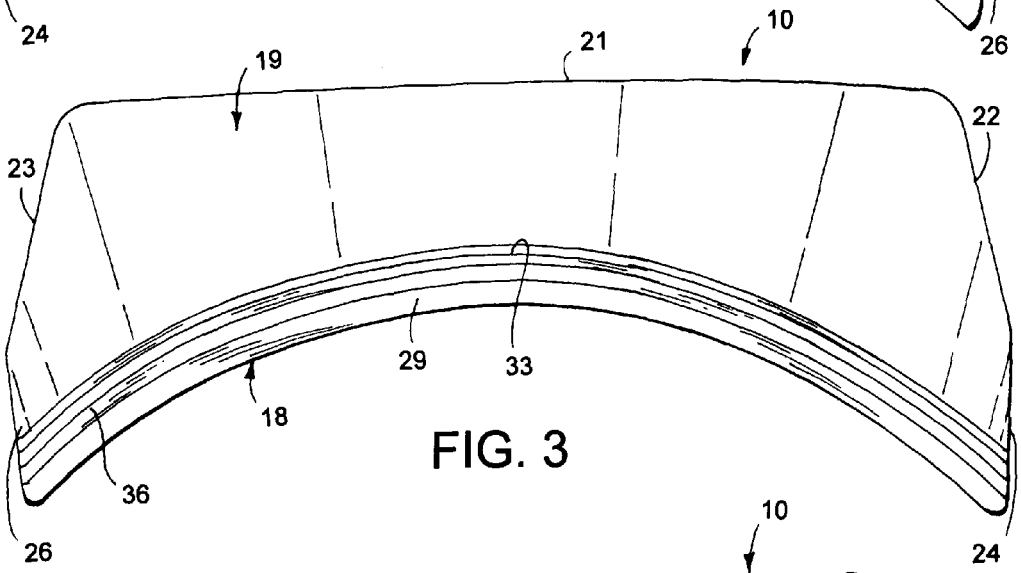
FIG. 3 is a back elevational view of the pouring spout of FIG. 1.
Figure 4:
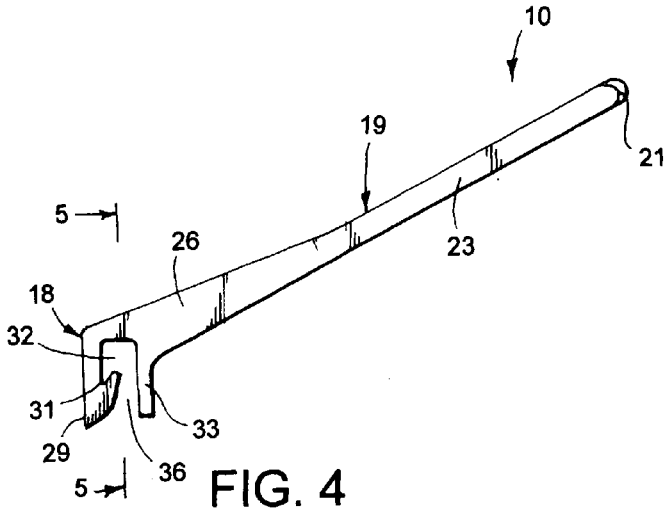
FIG. 4 is a side elevational view of the pouring spout of FIG. 1.
Figure 9:
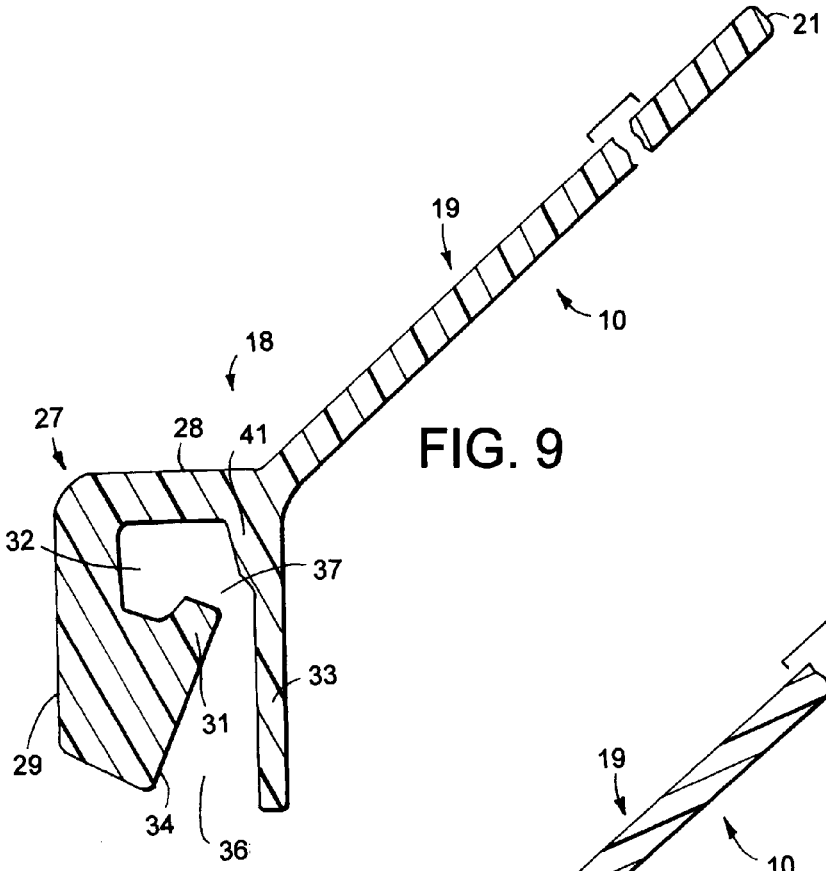
FIG. 9 is an enlarged foreshortened sectional view taken along line 9-9 of FIG. 2.

Pouring spout 10 is a one-piece flexible plastic member that is injection molded from plastic material, such as low density polyethylene. Other types of materials can be used to make pouring spout 10. As shown in FIGS. 2-4, pouring spout 10 has a convex curved base 18 and a generally flat lip 19 integral with the convex side of base 18. Base 18 has a radius of curvature substantially larger than the radius of curvature of bead 17. In use, base 18 is an arcuate spring rib that biases the walls of base 18 into sealing relationship with container wall 16 and bead 17. Lip 19 has an outwardly curved outer edge 21 joined to downwardly and outwardly directed side edges 22 and 23. The opposite ends of base 18 are joined to side edges 22 and 23 with tapered walls 24 and 26 that reinforce the plastic connection between the opposite ends of base 18 and lip 19 and function as dams to direct paint over the top surface of lip 19 when paint is poured out of container 11. As shown in FIG. 9, base 18 has a top arcuate rib 27 continuously extended between walls 24 and 26. Rib 27 has a top wall 28 extended outwardly and downwardly from the top surface of lip 19 and a bottom wall 29 extended downwardly and outwardly from top wall 28. Bottom wall 29 has an upwardly extended hook flange 31 located below top wall 28 forming an arcuate pocket or cavity 32. Flange 31 has the same convex curvature as base 18 and continuously extends between the opposite ends of base 18. Base 18 includes a continuous arcuate flange 33 spaced inwardly from hook flange 31 and pocket 32. Wall 29 has an inside upwardly inclined surface 34 extended to hook flange 31 providing a converging tapered mouth or passage 36 to pocket 32. Passage 36 has a restricted arcuate throat 37 adjacent the end of hook flange 31. The tapered mouth 36 facilitates the press fitting of pouring spout 10 through throat 37 and around bead 17 as inclined surface 34 guides bead 17 to throat 37.

Figure 5:
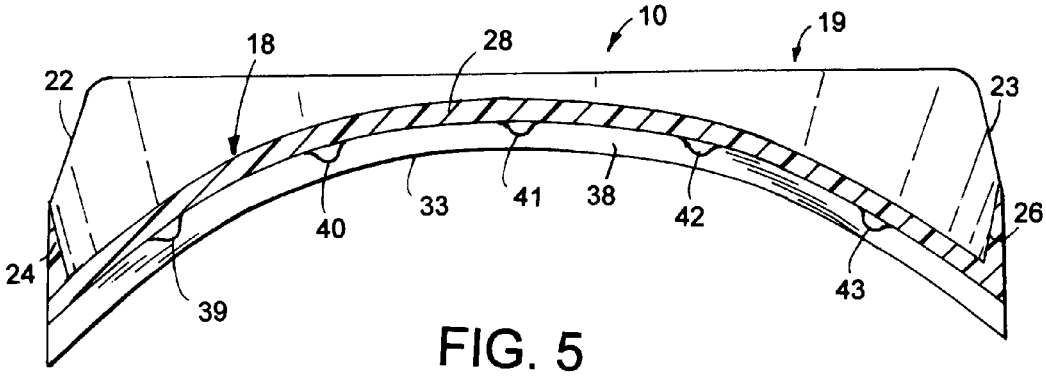
FIG. 5 is a sectional view taken along line 5-5 of FIG. 4.
Figure 6:
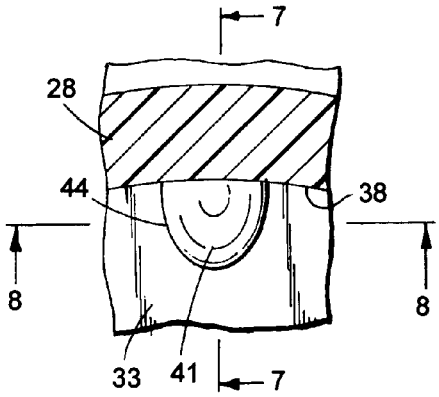
FIG. 6 is an enlarged central portion of FIG. 5.
Figure 7:
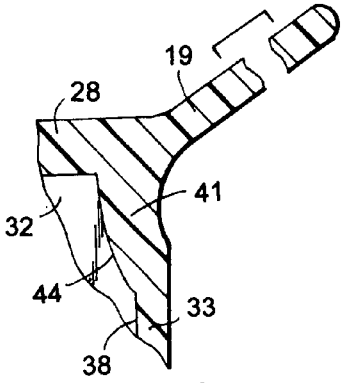
FIG. 7 is a foreshortened sectional view taken along line 7-7 of FIG. 6.
Figure 8:
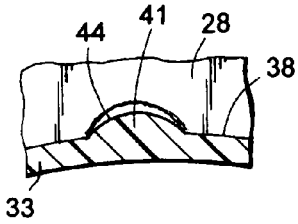
FIG. 8 is a sectional view taken along the line 8-8 of FIG. 6.
Figure 11:
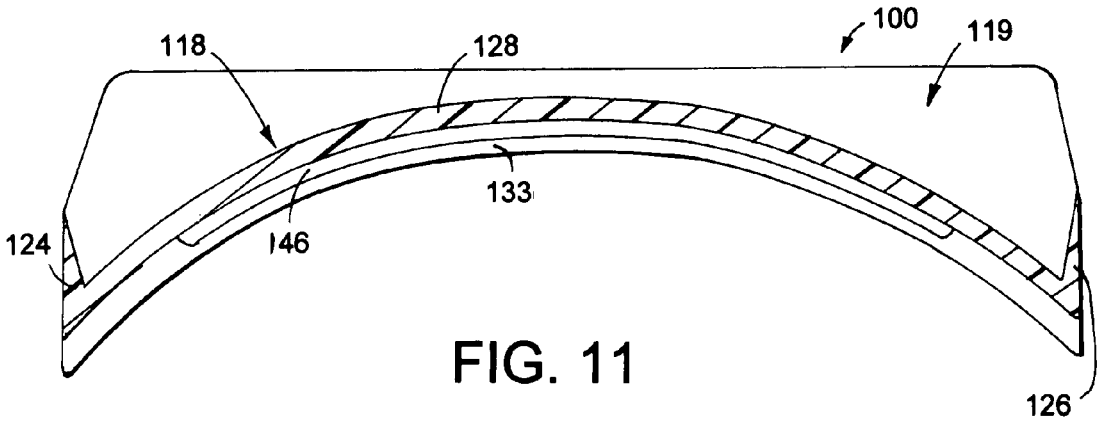
FIG. 11 is a sectional view similar to FIG. 5 showing a modification of the boss joined to flange of the base of the pouring spout.
Figure 12:
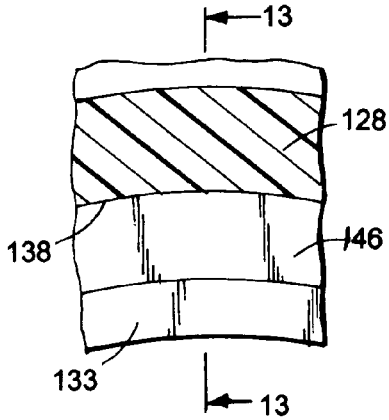
FIG. 12 is an enlarged central portion of FIG. 11.
Figure 13:
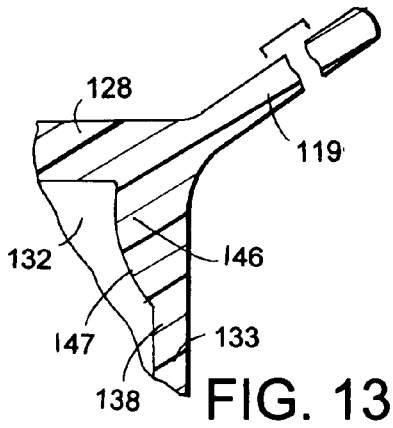
FIG. 13 is a foreshortened sectional view taken along the line 13-13 of FIG. 12.

As shown in FIG. 5, the inside surface 38 of flange 33 has arcuately spaced projections or bosses 38, 40, 41, 42 and 43 extended downwardly from top wall 28. Adjacent bosses 39-43 are spaced an equal arcuate distance from each other with bosses 39 and 43 spaced inwardly from end walls 26 and 27 whereby bosses 39 and 43 do not interfere with the initial press fitting of pouring spout on bead 17. Five bosses 39-43 are shown in FIG. 5. The number of bosses can be increased or decreased. As shown in FIGS. 11 to 13, a single boss 146 can be arcuately located on flange 133 in lieu of bosses 39-43. The outer surface of the single boss 146 has a convex inclined surface 147 as shown in FIG. 13. The parts of pouring spout 100 shown in FIGS. 11-13 that correspond to pouring spout 10 have the same reference numbers with the prefix 1. A detailed illustration of boss 41 is shown in FIGS. 6, 7 and 8. Bosses 39, 40, 42 and 43 have the same size and shape as boss 41. Boss 41 is a semi-ellipsoid having a downwardly extended semi-elliptical surface 44. Surface 44 has downwardly directed convex or inclined shape as shown in FIG. 7. Bosses 39-43 function together as compression springs that hold walls 28 and 29 and hook flange 31 in tight sealing relation with bead 17. Bosses 39-43 extend into throat 37 when pouring spout 10 is attached to bead 17 whereby the plastic material of bosses 39-43 and flange 33 is compressed. The compressed bosses 39-43 and flange 33 biases top rib 27 in tight sealing relationship with bead 17 thereby preventing paint from flowing under pouring spout 10. Flange 33 engages cylindrical wall 16 to limit pivotal movement of pouring spout 10 on bead 17. Bosses 39-43 compensate for mold tolerances and plastic shrinkage.

A modification of the pouring spout 100, shown in FIGS. 11 to 13, is a one-piece plastic member having a convex curved base 118 joined to a lip 119 and side edges 124 and 126. Base 118 has a top arcuate top wall 128 spaced from a continuous arcuate flange 133. An arcuate pocket or cavity 132 with open opposite ends is located between wall 128 and flange 133. The inside surface 138 of flange 133 has a continuous boss 146 having an inclined surface 147 as shown in FIG. 13. The opposite ends of boss 146 are spaced inwardly from the open ends of the base to allow the base to be snapped onto bead 17.

In use, an open end of base 18 is placed on top of a portion of bead 17 and forced down on the bead. Downward force is progressively applied along base 18 to change the curvature of the base 18 and lip 19 and snap 18 onto bead 17. The inclined surface 34 of wall 29 guides rib 27 downwardly forcing bead 17 to move through throat 37 into pocket 32. Downward force along the length of rib 27 progressively snaps rib 27 on bead 17. The arcuate biasing force of rib 27 on bead 17 holds pouring spout on bead 17. Flange 33 located in engagement with the outside of cylindrical wall 16 retains lip 19 at an upright and outwardly directed angle relative to container 11. For example, the angle of lip can be 30 degrees relative to the horizontal plane of the top of container 11. Lip 19 is retained by rib 27 in a general U-shaped trough that directs the flow of paint from container 11 during pouring of paint out of the container. Bosses 38-43 are compressed against bead 17 to retain rib 27 in tight sealing relation with bead 17 thereby preventing paint from leaking between rib 27 and bead 17 and running down the outside of the can.

The drawing and description herein is directed to a preferred embodiment of the pouring spout of the invention. Changes, omissions, substitutions of parts and materials and size of the pouring spout must be made by persons skilled in the art without departing from the invention.

The invention claimed is:

1. A spout for use with a container having a bead surrounding an open top of the container comprising: a one-piece flexible member having an arcuate base and a generally flat lip joined to the base, said base having opposite side edges, a top wall, an arcuate rib with a pocket to accommodate the bead in the pocket, an arcuate flange spaced from the rib to provide a passage into the pocket, and a plurality of bosses joined to and arcuately spaced along the top wall and flange adapted to cooperatively bias the rib in tight sealing relationship with the bead located in the pocket, said plurality of bosses including opposite end bosses spaced inwardly of the opposite side edges of the base, the rib having a bottom wall joined to the top wall, said bottom wall having an upwardly directed arcuate hook flange, said top wall, bottom wall and hook flange surrounding said pocket, said bottom wall and hook flange providing the passage into the pocket, said hook flange and arcuate flange providing said passage with a throat adjacent the pocket, said plurality of bosses extending into the throat to bias the rib in tight sealing relationship with the bead located in the pocket.

2. The combination of a container for holding a liquid having an open top and a circular bead surrounding said open top, and a spout having an arcuate base, a top wall, and a lip joined to the base, said base having opposite side edges and a radius of curvature greater than the radius of curvature of the circular bead, said base having an arcuate rib with an arcuate pocket accommodating an arcuate portion of the bead, an arcuate flange spaced from the rib providing a passage into the pocket, and a plurality of bosses joined to and arcuately spaced along the top wall and the flange compressed against the bead to bias the rib in tight sealing relationship with the bead to prevent liquid from leaking between the bead and spout, said plurality of bosses including opposite end bosses spaced inwardly of the opposite side edges of the base, the rib having a bottom wall joined to the top wall, said bottom wall having an upwardly directed arcuate hook flange, said top wall, bottom wall and hook flange surrounding said pocket, said bottom wall and hook flange providing the passage into the pocket, said hook flange and arcuate flange providing said passage with a throat adjacent the pocket, said plurality of bosses extending into the throat to bias the rib in tight sealing relationship with the bead located in the pocket.

* * * * *